US007176629B2

(12) United States Patent
Jang

(10) Patent No.: US 7,176,629 B2
(45) Date of Patent: Feb. 13, 2007

(54) PLASMA DISPLAY PANEL HAVING THICKER AND WIDER INTEGRATED ELECTRODE

(75) Inventor: Tae-Woong Jang, Cheonan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 10/956,134

(22) Filed: Oct. 4, 2004

(65) Prior Publication Data

US 2005/0083254 A1 Apr. 21, 2005

(30) Foreign Application Priority Data

Oct. 21, 2003 (KR) ..... 10-2003-0073417

(51) Int. Cl.
*H01J 17/49* (2006.01)

(52) U.S. Cl. ..... 313/583; 313/582

(58) Field of Classification Search ..... 313/582–587; 315/169.4; 345/37, 41, 60
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,747,939 | A * | 5/1998 | Kim et al. | 315/169.4 |
| 5,786,794 | A | 7/1998 | Kishi et al. | |
| 5,952,782 | A | 9/1999 | Nanto | |
| RE37,444 | E * | 11/2001 | Kanazawa | 345/67 |
| 6,433,489 | B1 * | 8/2002 | Tanaka et al. | 315/169.4 |
| 6,630,916 | B1 | 10/2003 | Shinoda | |
| 6,707,436 | B2 | 3/2004 | Setoguchi et al. | |
| 6,734,626 | B2 * | 5/2004 | Yoshioka et al. | 313/585 |
| 2002/0050788 | A1 * | 5/2002 | Kimura et al. | 313/582 |

(Continued)

FOREIGN PATENT DOCUMENTS

| | | |
|---|---|---|
| JP | 02-148645 | 6/1990 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph Williams
*Assistant Examiner*—Bumsuk Won
(74) *Attorney, Agent, or Firm*—Robert E. Bushnell, Esq.

(57) ABSTRACT

A plasma display panel (PDP) with a novel electrode structure. An integrated bus electrode located outside of the display region is connected to many image display electrodes. This integrated bus electrode is designed to be wider and thicker in order to reduce electrical resistance and thus reduce the generation of Joule heat in the periphery regions of the PDP. This integrated bus electrode is flush with the edge of the display and is connected to a flexible printed cable which connects to drivers. Alignment marks are placed on the integrated bus electrode to locate exactly where the flexible printed cable attaches to the integrated bus electrode.

20 Claims, 7 Drawing Sheets

U.S. PATENT DOCUMENTS

| | | | | |
|---|---|---|---|---|
| 2002/0089285 | A1* | 7/2002 | Nishiki et al. | 313/583 |
| 2003/0127981 | A1* | 7/2003 | Otani et al. | 313/582 |
| 2004/0239591 | A1* | 12/2004 | Sekii | 345/60 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| KR | 10-2001-0092911 | 10/2001 |
| KR | 2001-0104612 | 11/2001 |

* cited by examiner

PLASMA DISPLAY PANEL HAVING THICKER AND WIDER INTEGRATED ELECTRODE

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 21 Oct. 2003 and there duly assigned Serial No. 2003-73417.

BACKGROUND OF THE INVENTION

1. Field of the Invention

The present invention relates to a plasma display panel, and more particularly, to a plasma display panel with a novel design for an integrated electrode formed at an edge of the display. The integrated electrode is formed to be thicker and wider to have a larger cross sectional area and thus reduce resistance and thus reduce heat generated during operation.

2. Description of the Related Art

A plasma display panel (PDP) can be classified into a direct current (DC) type and an alternating current (AC) type according to how it discharges. In the DC type PDP, electrodes are exposed in a discharging space, and charged particles move directly between the corresponding electrodes. In the AC type PDP, at least one electrode is covered by a dielectric layer, and discharging occurs through an electric field of a wall charge instead of the particles directly moving between the electrodes.

A problem occurs in a PDP that electrodes in the PDP generate heat when energized. This heat causes the glass substrates to heat up encouraging the glass substrates to crack. This overheating problem and this cracking problem is particularly applicable to large PDPs where the screen size is large and thus the electrodes are longer and carry more power and thus generate more Joule heat. Therefore, what is needed is a design for a PDP that reduces the Joule heating caused by electrodes in the display.

SUMMARY OF THE INVENTION

It is therefore an object of the present invention to provide an improved design for a PDP.

It is also an object of the present invention to provide a design for a PDP that is more efficient by limiting the amount of Joule heat generated by electrodes in the PDP.

It is further an object of the present invention to provide an improved design for a PDP that reduces the amount of heat generated by the electrodes.

It is still an object of the present invention to provide a plasma display panel (PDP) having bus electrodes having a structure by which the amount of generated heat that is discharged from a non-image area can be reduced.

These and other objects can be achieved by a plasma display panel including an image area that can display images and a non-image area that cannot display images, the plasma display panel including a lower plate including a rear substrate and a plurality of address electrodes formed on a top surface of the rear substrate in a predetermined pattern, and an upper plate including a front substrate that faces the rear substrate, bus Y electrodes that cross the address electrodes on a lower portion of the front substrate, and bus X electrodes. The bus X electrodes include a plurality of image bus X electrodes ranging from the image area to the non-image area and an integrated bus X electrode, which is formed on the non-image area, having one side portion that is connected to all of the image bus X electrodes and the other side portion that is formed to be flush with a side edge portion of the front substrate and is connected to a flexible printed cable. An alignment mark may be formed on a portion of the integrated bus X electrode, which is connected to the flexible printed cable.

The thickness of the integrated bus X electrode may be thicker than that of the image bus X electrodes. The width of the integrated bus X electrode may also be formed to be wider so that an outside edge of the integrated bus X electrode extends to an edge of the PDP. This other side portion of the integrated bus X electrode may be formed at the same position as that of a side edge portion of the front substrate and is connected to a flexible printed cable. An alignment mark may be formed is at the portion of the integrated bus X electrode, which is connected to the flexible printed cable. The integrated bus X electrode may be black in color and may be made out of the same material as the image electrodes so that they can be both formed at the same time and of the same material and have a pleasant appearance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
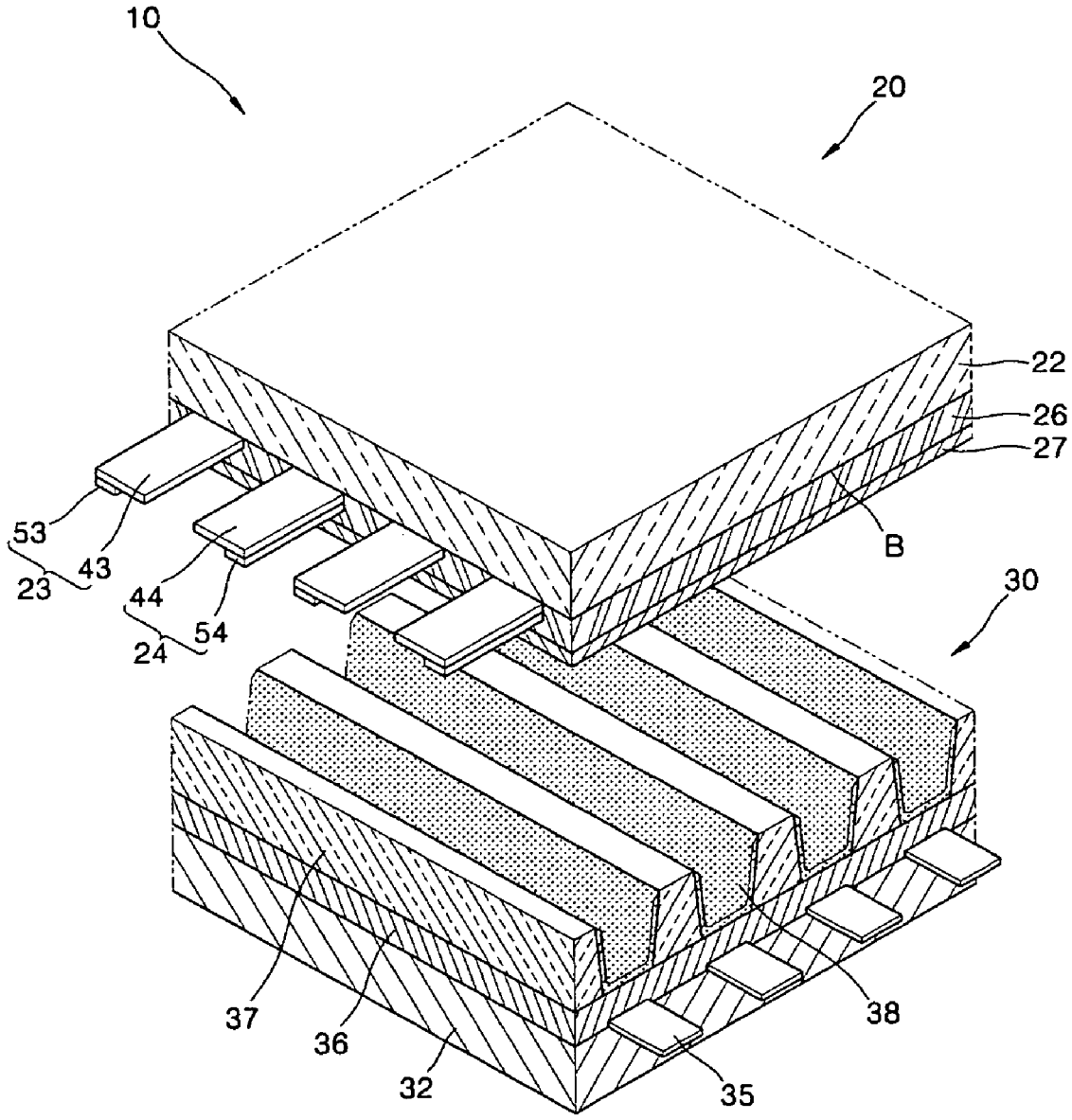
FIG. 1 is a perspective view of a plasma display panel (PDP)
Figure 7:
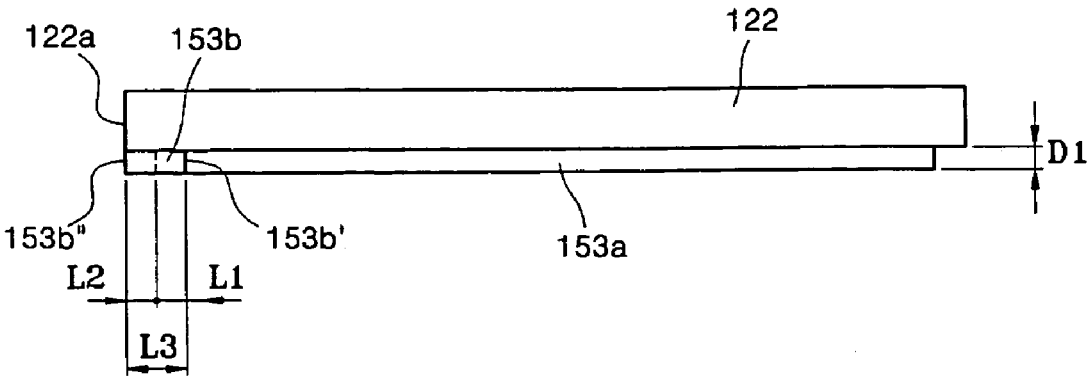
FIG. 7 is a cross-sectional view taken along line VII—VII of FIG. 6.

FIG. 1 is a perspective view of a general AC type PDP 10 that is similar to FIG. 7 of Japanese Laid-open Patent No. 1999-149873. Referring to FIG. 1, the general PDP 10 includes an upper plate 20 that shows images to a user and a lower plate 30 that is disposed to face the upper plate 20.

The upper plate 20 includes a front substrate 22 and a plurality of electrodes. The front substrate 22 is generally a glass substrate and includes pairs of transparent X electrodes 43 and transparent Y electrodes 44 on a lower surface B (−z surface) thereof. The transparent X electrodes 43 and the transparent Y electrodes 44 are transparent electrodes formed of indium-tin-oxide (ITO) and are referred to as transparent electrodes. Bus X electrodes 53*a* and bus Y electrodes 54*a*, which are formed of metal materials, for example, are respectively disposed on lower portions (−z-portions) of the transparent electrodes 43 and 44 respectively in order to reduce line resistance. Sustain discharging occurs through an X electrode 23 made up of one transparent X electrode 43 and one bus X electrode 53*a* and a Y electrode 24 made up of one transparent Y electrode 44 and one bus Y electrode 54*a*. One X electrode 23 and one Y electrode 24 form a pair of sustain electrodes and run in the y-direction.

The lower plate 30 includes a rear substrate 32 and address electrodes 35. The address electrodes 35 are disposed on an upper surface (+z surface) of the rear substrate 32. Rear substrate 32 is disposed to face the front substrate 22 and is oriented so that the address electrodes 35 on the rear substrate 32 cross the pairs of sustain electrodes of the front substrate 22. Thus, the address electrodes 35 run in an x direction and are essentially orthogonal to the X electrodes 23 and the Y electrodes 24.

A front dielectric layer 26 formed on a lower surface B (−z surface) of the front substrate 22 covers a plurality of X electrodes 23 and Y electrodes 24. A rear dielectric layer 36 formed on the upper surface (+z surface) of the rear substrate 32 covers the address electrodes 35. A protective layer 27 generally formed of MgO is formed on a lower surface (−z surface) of the front dielectric layer 26. A barrier rib 37 that maintains a discharging distance and prevents electrical and optical cross-talk between cells is formed on the rear dielectric layer 36. Phosphors 38 of red, green, and blue colors are applied on both side surfaces of the barrier rib 37 and on the upper surface (+z surface) of the rear dielectric layer 36 on portions of the dielectric layer 36 between barrier ribs 37.

The PDP 10 having the above structure operates in the following way. When a predetermined voltage is applied to the address electrodes 35 and the Y electrodes 24, a cell emitting light is selected, and address discharge occurs between these two electrodes in the selected cell to accumulate a wall charge on the front dielectric layer 26. Then, when a predetermined voltage is applied between the a pair of sustain electrodes, the wall charge moves between the sustain electrodes to generate sustain discharge through the gas. Accordingly, ultraviolet radiation is generated by the gas, and the ultraviolet radiation excites the phosphors 38 to form visible images.

In the above case, the PDP 10 controls the number of sustain discharges according to video data to realize the gray level required to display the images. In addition, in order to represent the gray level, an address, display-period separation method (ADS method) that divides one time frame into a plurality of temporal sub-fields having different discharging times and operates the sub-fields is used. Each sub-field is divided into a reset period for generating even discharging, an address period for selecting a light emitting cell that emits the radiation, a sustain period that represents the gray level according to the number of discharging operations, and an erasing period.

Figure 2:
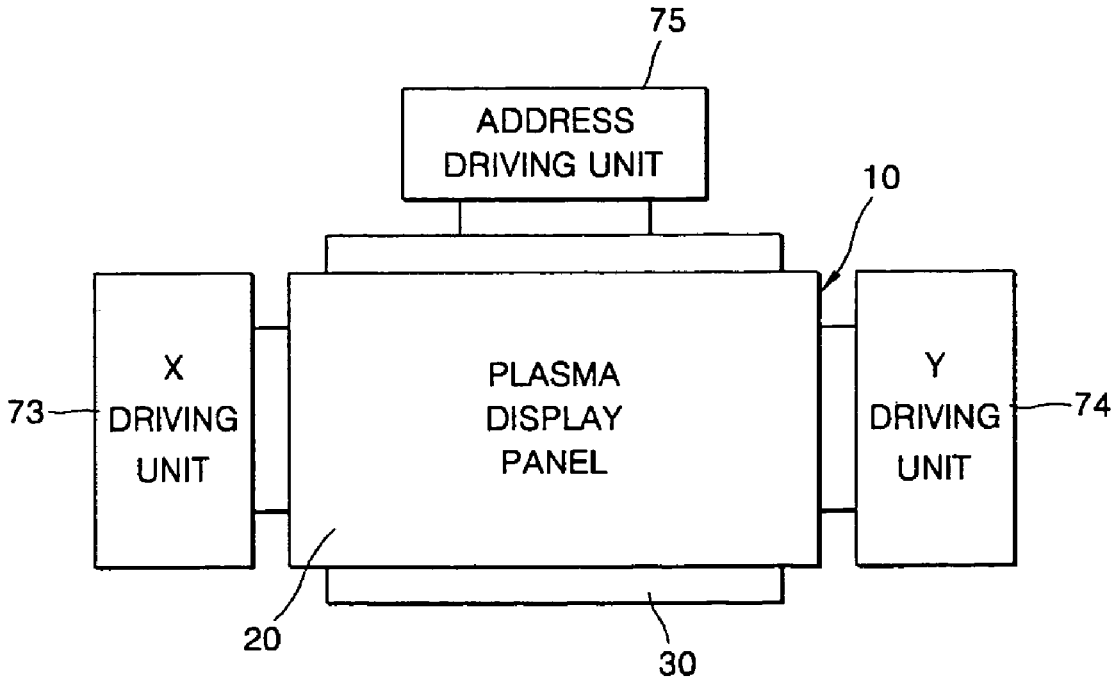
FIG. 2 is a block diagram of driving units that are connected to the PDP shown in FIG. 1.

As illustrated in FIG. 2, in the PDP 10 as described above, the address electrodes 35 formed over the lower plate 30 are connected to an address driving unit 75. The X electrodes 23 formed on the upper plate 20 are connected to an X driving unit 73. The Y electrodes 24 formed on the upper plate 20 are connected to the Y driving unit 74. The address driving unit 75, the X driving unit 73, and the Y driving unit 74 control the images displayed. A voltage is applied to the X electrodes 23 through the bus X electrodes 53*a*. The same voltage is applied to the bus X electrodes 53*a* in the reset period, the address period, the sustain period, and the erasing period.

Figure 3:
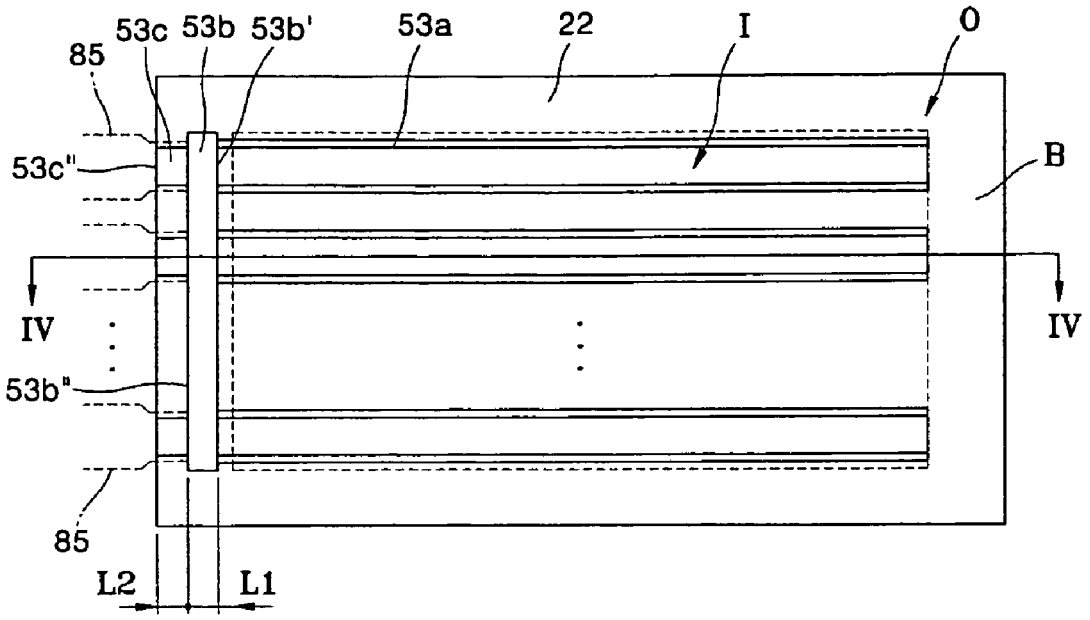
FIG. 3 is a plan view illustrating the structure of bus electrodes of the PDP of FIG. 1.
Figure 4:
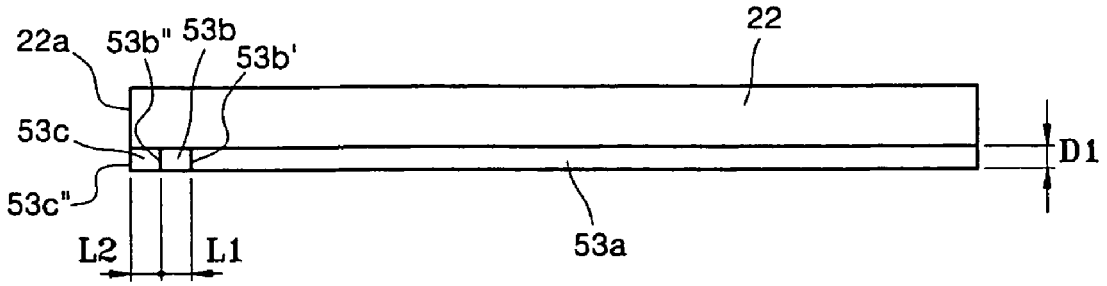
FIG. 4 is a cross-sectional view taken along line IV—IV of FIG. 3.

The structure of the bus X electrodes 53*a* will be described in detail with reference to FIGS. 3 and 4. FIG. 3 illustrates the front substrate 22 turned over so that the lower surface B (−z surface) faces up. As illustrated in FIG. 3, the front substrate 22 can be divided into an image area I that displays images and a non-image area O that does not display images. Essentially non-image area O surrounds image area I and non-image area O is formed at a periphery of the PDP 10. In the image area I, a plurality of image bus X electrodes 53*a*, one pair per cell, are formed in a constant pattern.

All of the image bus X electrodes 53*a* are connected to a one side portion 53*b*' of an integrated bus X electrode 53*b*. The integrated bus X electrode 53*b* has a predetermined width L1 and a predetermined thickness D1. The thickness D1 of bus X electrode is the same as the thickness of the image bus X electrodes 53*a*. A other Another side portion 53*b*" of the integrated bus X electrode 53*b* is connected to drive connect bus X electrodes 53*c*. Drive connect bus electrodes 53*c*is also electrically connected to a flexible printed cable (FPC) 85. The drive connect bus X electrodes 53*c* protrude beyond the integrated bus X electrode 53*b* at a position that corresponds to a plurality of FPCs 85. The drive connect bus X electrodes have a length L2 to fill in the gap between the integrated bus X electrode 53*b* and an edge of front substrate 22. An end portion 53*c*" of drive connect bus X electrode 53*c* is formed at the same position and is essentially flush (i.e., level or even) with a side edge portion 22*a* of the front substrate 22.

The same voltage is applied to each of the image bus X electrodes 53*a* having the above structure at the same time. Thus, the integrated bus X electrode 53*b* that is connected to all of the image bus X electrodes 53*a* absorbs the current generated in the image area I, and the voltage induced by the control of the driving units is distributed to each of the image common electrodes 53*a*. As a result, a large amount of heat is generated in the non-image area O by the integrated bus X electrode 53*b*. Accordingly, high-temperature heat is generated locally on the PDP 10, and the performance of the PDP 10 is consequently degraded by such losses in the integrated portion 53*b* of the bus X electrode 53.

That is, the heat generated by the integrated bus X electrodes 53*b* disposed on the non-image area O is transmitted to the front substrate 22, and the temperature on the surface of the glass substrate may rise to 70° C. or more due to the Joule heat transmitted to the front substrate 22. At such temperatures, the front substrate 22 thermally expands, and since the front substrate 22 and the rear substrate 23 are fixed to each other by a sealing material, the front substrate 22 may be bent as a bimetal. When the front substrate 22, which is generally a glass substrate, is bent, the front substrate 22 is compressed by thermal stress. If the glass substrate has a fine recess or a defect, thermal stress is concentrated on the defect, resulting in the possible generation of a crack on that portion of the glass substrate leading to degradation in the image quality of the PDP. As PDPs become larger, the amount of current applied to the PDP also increases, and more heat gets generated by the integrated bus X electrodes 53*b* disposed on the non-image area O of the PDP.

Figure 5:
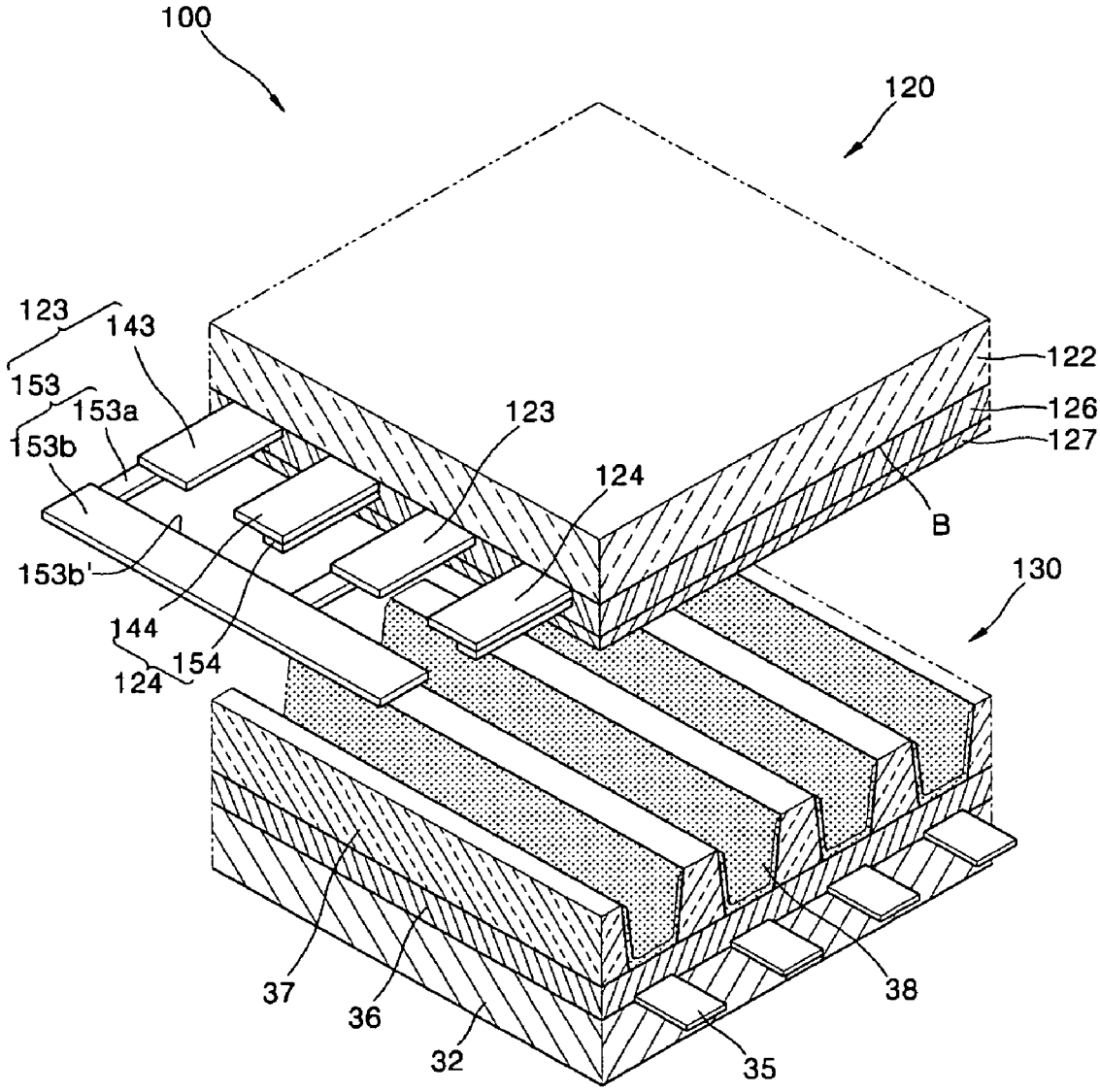
FIG. 5 is a perspective view illustrating a PDP according to a first embodiment of the present invention.

Referring to FIG. 5, a plasma display panel (PDP) 100 according to a first embodiment of the present invention includes a lower plate 130 and an upper plate 120 that is disposed to face the lower plate 130 and to display images. The lower plate 130 includes a rear substrate 32 and a plurality of address electrodes 35 that are formed in a predetermined pattern (and run in an x direction) on a top surface of the rear substrate 32. The upper plate 120 includes a front substrate 122 facing the rear substrate 32, bus Y electrodes 154 that are formed on a lower portion (−z portion) of the front substrate 122 and run in a y direction to cross the address electrodes 35, and bus X electrodes 153.

The Y electrodes 124, which generate address discharging with the address electrodes 35, and X electrodes 123, which generate sustain discharging when a voltage is alternately applied to the X and Y electrodes 123 and 124, are disposed in pairs on a lower surface B (−z surface) of the front substrate 122 of the upper plate 120 in an alternating current (AC) type PDP 100 as illustrated in FIG. 5.

In FIG. 5, each of the X electrodes 123 includes one transparent X electrode 143 and one bus X electrode 153 that is formed on a lower surface (−z surface) of the transparent X electrode 143 to compensate for the line resistance of the transparent X electrode 143. Furthermore, each of the Y electrodes 124 includes one transparent Y electrode 144 and one bus Y electrode 154 that is formed on a lower surface of the transparent Y electrode 144 to compensate for the line resistance of the transparent Y electrode 144. However, the X and Y electrodes 123 and 124 are not limited to the above structures, and the transparent X electrodes 143 and the transparent Y electrodes 144 maybe excluded. Further, in the drawings, the electrodes are placed in a XYXY pattern where the X electrodes 123 and the Y electrodes 124 are alternately arranged on cells, however, a XYYX pattern where the X electrodes 123 and the Y electrodes 124 are arranged in an opposite order on neighboring cells can be used instead.

A front dielectric layer 126 covering the X and Y electrodes 123 and 124 may be formed on a lower surface B (−z surface) of the front substrate 122. Further, a protective layer 127 may be formed on a lower surface (−z surface) of the front dielectric layer 126.

The address electrodes 35 run in a x direction and cross the X electrodes 123 and the Y electrodes 124 and are formed on a top side (+z side) of the rear substrate 32 that faces the front substrate 122. The address electrodes 35 are preferably covered by a rear dielectric layer 36. The address electrodes 35 form individual cells with the X and Y electrodes 123 and 124. A barrier rib 37 is formed on the rear dielectric layer 36 and separates the individual cells from each other. Phosphors 38 are applied to the inside of each of the individual cells to cover the sidewalls of the barrier ribs 37 and the exposed portions of the rear dielectric layer 36 between barrier ribs 37.

Bus X electrodes 153 include image bus X electrodes 153*a* formed on a lower portion (−z portion) of the front substrate 122 inside the image portion I and an integrated bus X electrode 153*b* that is connected with all of the image bus X electrodes 153*a* and is located outside of the image portion I. One side 153*b*' of the integrated bus X electrode 153*b* is connected to the image bus X electrodes 153*a*.

Figure 6:
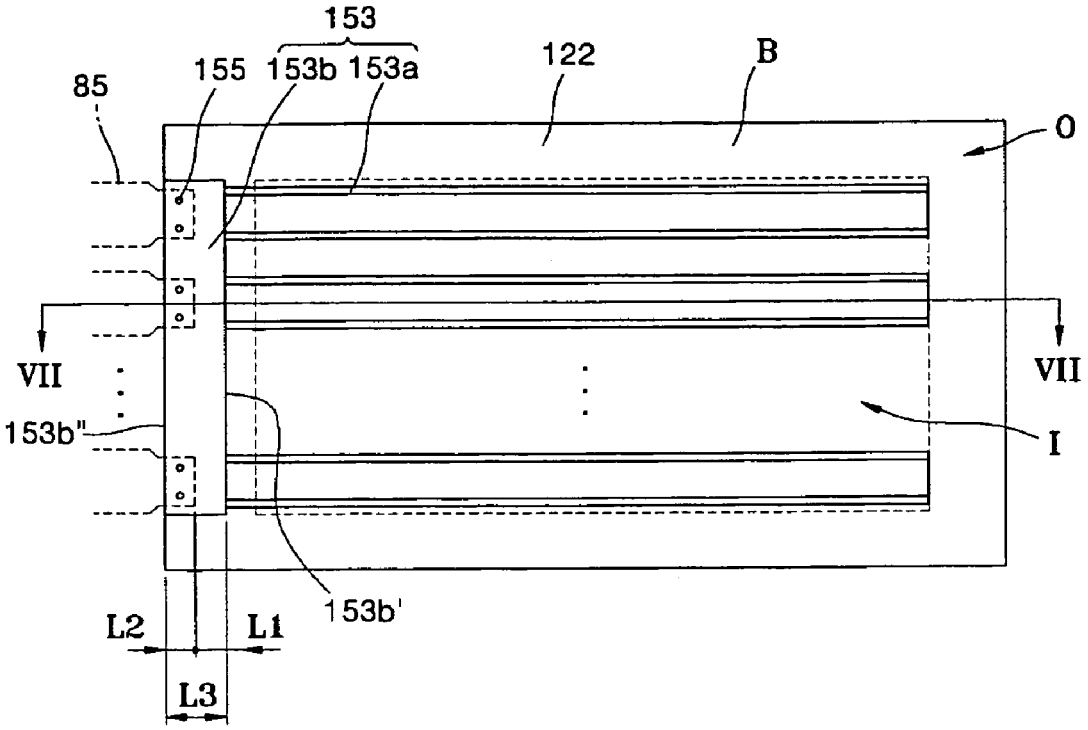
FIG. 6 is a plan view illustrating the structure of bus electrodes disposed on the PDP shown in FIG. 5.

The bus X electrodes 153 will be described in more detail with reference to FIGS. 6 and 7. A plurality of image bus X electrodes 153*a* are formed on the lower portion (−z portion) of the front substrate 122 spanning the image area I on which images can be displayed and the non-image area O that cannot display images. Here, FIG. 6 shows the front substrate 122 turned over so that the lower surface B (−z surface) faces up out of the page.

The image bus X electrodes 153*a* are connected to the one side 153*b*' of the integrated bus X electrode 153*b* in the non-image area O that cannot display images, so as to communicate with the integrated bus X electrode 153*b*.

The integrated bus X electrode 153*b* includes the other side portion 153*b*" that is opposite one side 153*b*'. Preferably, side 153*b*" is essentially flush with side edge portion 122*a* of the front substrate 122. The side 153*b*" is connected to a FPC 85 which is connected to an X driving unit 73 (refer to FIG. 2). Thus, the width L3 (where L3=L1+L2) of the integrated bus X electrode 153*b* is greater than the width L1 of the integrated bus X electrode 53*b* of the PDP 10 of FIGS. 1, 3 and 4 by as much as the width L2 of the driving connecting bus X electrode 53*c* of FIGS. 3 and 4.

Generally, discharged heat is caused by electrical resistance, and the magnitude of the electrical resistance is proportional to length and in inversely proportional to area. Specifically, when it is assumed that R denotes electrical resistance, l denotes the length of a wire, and A denotes the cross-sectional area of the wire, the relationship between them can be represented by $R=\rho l/A$, where ρ denotes a specific resistance. As shown in the above equation, electrical resistance is proportional to the length l of a wire and inversely proportional to the cross-sectional area A of the wire. Thus, when the width of the integrated bus X electrode 153*b* increases, the cross-sectional area A of the electrode 153*b* also increases, causing the resistance R and thus the heat generated by the integrated bus X electrode 153*b* to be reduced. Consequently, the amount of heat radiated from the non-image area O of PDP 100 can be reduced compared to PDP 10 of FIGS. 1, 3 and 4, and thermal expansion of the front substrate 122 can be thus prevented.

On the other hand, since the integrated bus X electrode 153*b* of FIG. 6 does not require a drive connect bus X electrode 53*c* as in PDP 10 of FIG. 3, the portion of the bus X electrode 153 that connects to the FPC 85 does not protrude. Because the protrusions 53*c* do not exist on the bus X electrode 153 of FIG. 6, an alignment mark 155 is placed on a portion of the integrated bus X electrode 153*b* to indicate where the integrated bus X electrode 153*b* connects to the FPC 85.

Also, it is desirable that the integrated bus X electrode 153*b* is black in color so that the integrated bus X electrode can be integrally formed with the image bus X electrode 153*a*, which is also generally black. By having both the bus portion 153*b* and the image portion 153*a* of the X electrode 153 black and made out of the same material, the appearance of the entire bus X electrode 153 is improved.

Figure 8:
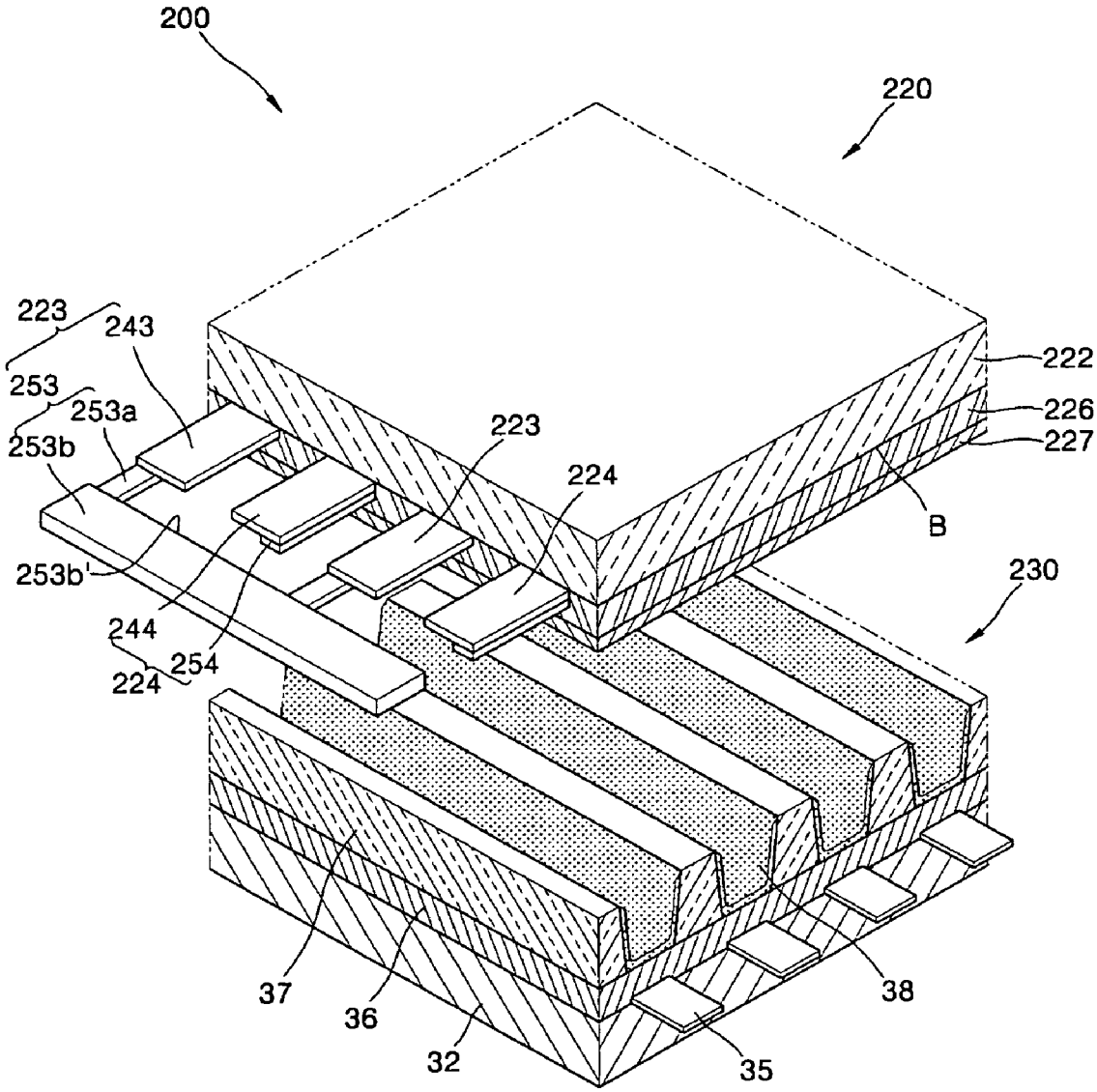
FIG. 8 is a perspective view illustrating an upper plate of a PDP according to a second embodiment of the present invention.

Turning now to FIG. 8, FIG. 8 illustrates a PDP 200 according to a second embodiment of the present invention. The PDP 200 of FIG. 8 includes an upper plate 220 and a lower plate 230.

The lower plate 230 includes a rear substrate 32 and a plurality of address electrodes 35 formed on a top surface (+z surface) of the rear substrate 32 in a constant pattern running in an x direction. The upper plate 220 includes a front substrate 222 facing the rear substrate 32, bus Y electrodes 254 running in a y direction and crossing the address electrodes 35 on a lower portion (−z portion) of the front substrate 222, and bus X electrodes 253. Here, the lower plate 230 including the rear substrate 32, the address electrodes 35, a rear dielectric layer 36, a barrier rib 37, and phosphors 38 have the same functions and structures as those of the lower plate 130 of FIG. 5, and thus the detailed descriptions for the lower plate 230 will be omitted.

In FIG. 8, X electrodes 223 and Y electrodes 224 are disposed in pairs on a lower surface B (−z surface) of the front substrate 222 of the upper plate 220. Each of the X electrodes 223 include one transparent X electrode 243 and one bus X electrode 253 that is formed on a lower surface (−z surface) of the transparent X electrode 243 to compensate for the line resistance of the transparent X electrode 243. Each of the Y electrodes 224 include one transparent Y electrode 244 and one bus Y electrode 254 that is formed on a lower surface (−z surface) of the transparent Y electrode 244. However, the X and Y electrodes 223 and 224 are not limited to the above structures, and the transparent X electrode 243 and the transparent Y electrode 244 may be excluded. Also, a XYXY pattern is shown in the drawings where the X electrodes 123 and the Y electrodes 124 are arranged alternately on cells, however, a XYYX pattern where the X electrodes 123 and the Y electrodes 124 are arranged in an opposite order on neighboring cells can be used instead.

A front dielectric layer 226 that covers the X and Y electrodes 223 and 224 may be formed on the lower surface B (−z surface) of the front substrate 222, and a protective layer 227 may be formed on a lower surface (−z surface) of the front dielectric layer 226.

The bus X electrodes 253 include image bus X electrodes 253*a* and an integrated bus X electrode 253*b* that is connected with all of the image bus X electrodes 253*a* on one side portion 253*b*' of the integrated bus X electrode 253*b*.

Figure 9:
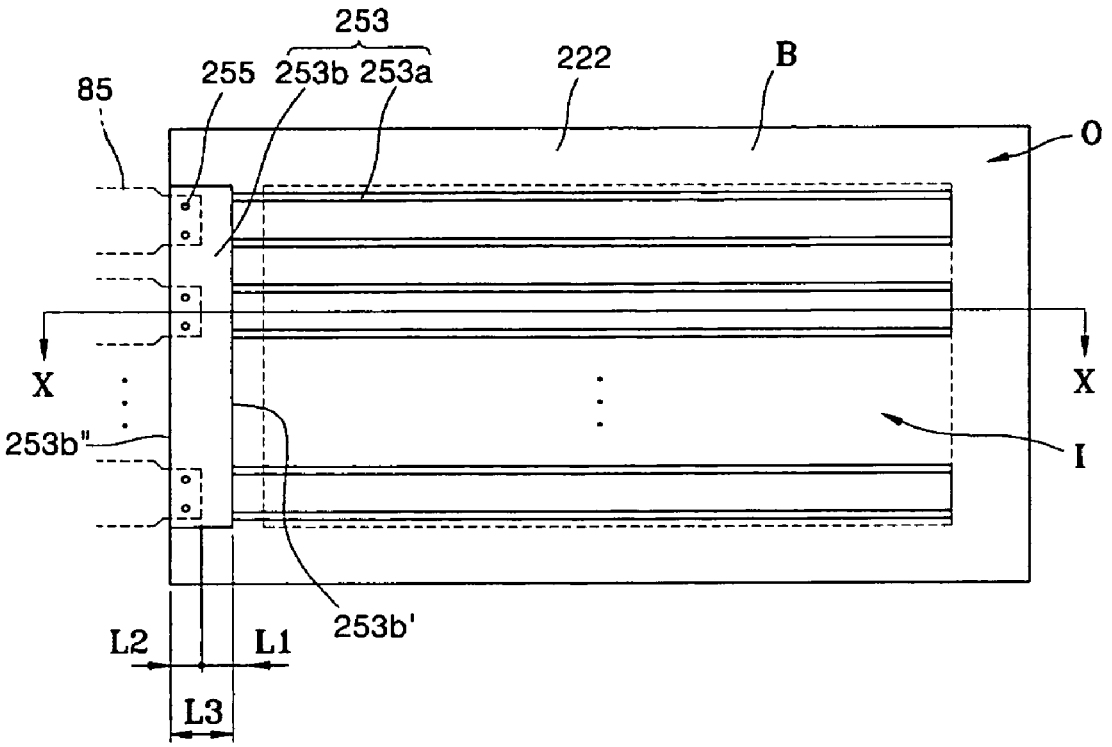
FIG. 9 is a plan view illustrating the structure of bus electrodes disposed on the PDP of FIG. 8.
Figure 10:
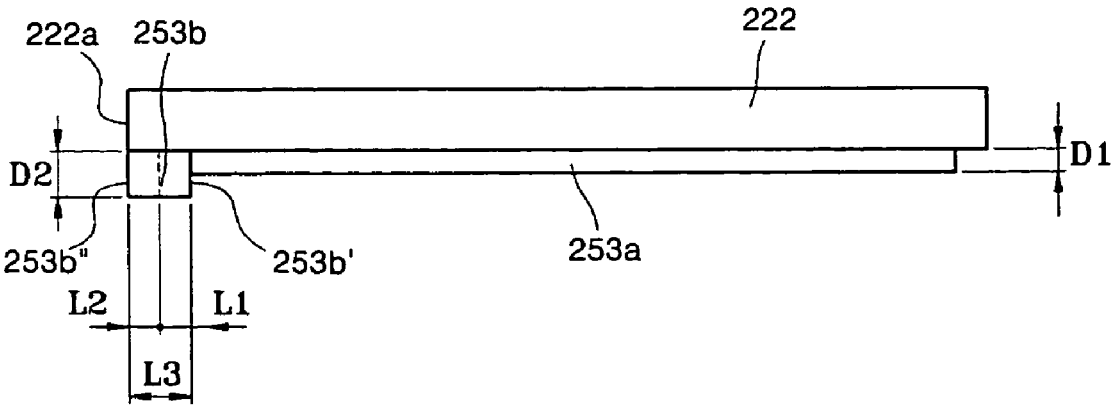
FIG. 10 is a cross-sectional view taken along line X—X of FIG. 9.

Hereinafter, the structure of the bus X electrodes 253 will be described in more detail with reference to FIGS. 9 and 10. FIG. 9 shows the front substrate 222 turned over so that lower surface B (−z surface) faces up out of the page. As shown in FIGS. 9 and 10, the PDP 200 can be divided into an image area I on which images can be displayed and a non-image area O where images cannot be displayed. The plurality of image bus X electrodes 253*a* are located over the entire image area I and on some portions of the non-image area O in a predetermined pattern. All of the image bus X electrodes 253*a* are connected to one side 253*b*' of the integrated bus X electrode 253*b* and communicate with the integrated bus X electrode 253*b*.

The thickness D2 of the integrated bus X electrode 253*b* is different from the thickness D1 of the image bus X electrodes 253*a*. Also, unlike the integrated bus X electrode 153*b* of FIGS. 5, 6 and 7, the integrated bus X electrode 253*b* of FIGS. 8, 9 and 10 is thicker by D2−D1, resulting in a larger cross-sectional area A for integrated bus X electrode 253*b* of FIGS. 8, 9 and 10 than for integrated bus X electrode 153*b* of FIGS. 5, 6 and 7, resulting in a lower resistance R and thus dissipating less heat than integrated bus electrode 153*b* of FIGS. 5, 6 and 7. Since the integrated bus X electrode 253*b* is connected to all of the image bus X electrodes 253*a* formed on the image area I, supplies a constant voltage to all of the image bus X electrodes 253*a* when controlled by the X driving unit 73 (refer to FIG. 2), and absorbs the current generated from the PDP 200, the integrated bus X electrode 253*b* discharges a different amount of heat than the image bus X electrodes 253*a*.

Specifically, as shown in FIG. 10, it is desirable that the thickness D2 of the integrated bus X electrode 253*b* is thicker than that the thickness D1 of the image bus X electrode 253*a*, and thus the amount of heat generated by the integrated bus X electrode 253*b* formed on the non-image area O is reduced.

That is, when it is assumed that R denotes electrical resistance, l denotes the length of a wire, and A denotes the area of the wire, the electrical resistance is proportional to the length of the wire and inversely proportional to the area of the wire as shown in the equation $R=\rho l/A$, where ρ denotes specific resistance. However, the heat generated by the bus X electrodes 253 is a kind of electrical resistance, and the bus X electrodes 253 function as wires. Accordingly, when the thickness of the integrated bus X electrode 253*b* increases, the cross sectional area A of the electrode increases and the electrical resistance R is reduced. Thus, the heat generated by the integrated bus X electrode 253*b* is reduced, and consequently, the amount of heat discharged in the non-image area O in the PDP 200 can be reduced.

In order to further reduce the amount of heat generated, it is desirable that the width of the integrated bus X electrode 253*b* be increased to L3=L1+L2. Thus, it is desirable that the other side 253*b*" of the integrated bus X electrode 253*b* is formed at the same position as that of a side edge portion 222*a* of the front substrate 222 so that the edge portion 222*a* of front substrate 222 is flush with side 253*b*" of integrated bus electrode 253*b*. Then, the width L3 of the integrated bus X electrode 253*b* is increased by as much as the width L2 of the driving connecting bus X electrode 53*c* so as to be greater than the width L1 of the integrated bus X electrode 53*b* used in the PDP 10 of FIGS. 1, 3 and 4, and the cross-sectional area A of the integrated bus X electrode 253*b* is thus increased.

On the other hand, since the integrated bus X electrode 253*b* eliminates the need for the driving connecting bus X electrode 53*c* (refer to FIG. 3) used in the PDP 10, the portion of electrode 253*b* that is connected to the FPC 85 does not protrude from the electrode. Therefore, it is desirable that an alignment mark is formed on the portion of integrated bus X electrode 253*b* that connects to the FPC 85 because when the protrusion does not exist on the integrated bus X electrode 253*b*, the alignment position for the FPC 85 is not readily identifiable. With an alignment mark, the integrated bus X electrode 253*b* and the FPC 85 can be connected to each other at the proper place.

Also, it is desirable that the integrated bus X electrode 253*b* is black in color because the integrated bus X electrode 253*b* is preferably formed integrally with the image common electrode 253*a* which is generally black in color resulting in an improved appearance of the entire bus X electrode 253.

According to the present invention, the electrode resistance of bus electrodes located on a non-image area can be reduced. As a result, the amount of heat generated by the bus electrodes on the non-image area is reduced, and a local temperature increase on the PDP can be reduced. Thus, thermal stress is not concentrated on a front substrate, the generation of a defect or the bending of the substrate can be prevented, and consequently, the defect rate of the PDP can be reduced by the above changes to the designs of the integrated bus X electrode.

While the present invention has been particularly shown and described with reference to exemplary embodiments thereof, it will be understood by those of ordinary skill in the art that various changes in form and details maybe made therein without departing from the spirit and scope of the present invention as defined by the following claims.

What is claimed is:

1. A plasma display panel, comprising:

a lower plate comprising a rear substrate and a plurality of address electrodes arranged on a top surface of the rear substrate in a predetermined pattern; and an upper plate comprising a front substrate arranged to face the rear substrate, a plurality of bus Y electrodes that cross the address electrodes arranged on a lower portion of the front substrate along with a plurality of bus X electrodes, the upper and lower plates each comprising an image area that can display images and a non-image area that cannot display images, wherein the bus X electrodes comprise a plurality of image bus X electrodes arranged in the image area and extending into the non-image area and an integrated bus X electrode that is arranged in the non-image area, a first side of said integrated bus X electrode being connected to all of the image bus X electrodes and a second and opposite side of said integrated bus X electrode being connected to a flexible printed cable, said second side of said integrated bus X electrode being flush with an edge of said upper plate.

2. The plasma display panel of claim 1, the integrated bus X electrode comprising an alignment mark arranged on a portion of the integrated bus X electrode that connects to the flexible printed cable.

3. The plasma display panel of claim 2, the integrated bus X electrode being black in color.

4. The plasma display panel of claim 1, said integrated bus X electrode having a predetermined finite width.

5. The plasma display panel of claim 4, said width of said integrated bus X electrode being about the width of said non-image area where said integrated bus X electrode is arranged.

6. The plasma display panel of claim 1, said front substrate being transparent.

7. The plasma display panel of claim 1, the integrated bus X electrode running along said edge of said upper plate.

8. A plasma display panel, comprising:

a lower plate comprising a rear substrate and a plurality of address electrodes arranged on a top surface of the rear substrate in a predetermined pattern; and an upper plate comprising a front substrate arranged to face the rear substrate, a plurality of bus Y electrodes and bus X electrodes that cross the address electrodes on a lower portion of the front substrate, the plasma display panel comprising an image area that can display images and a non-image area that cannot display images, wherein the plurality of bus X electrodes comprise a plurality of image bus X electrodes extending from the image area into the non image area and an integrated bus X electrode that comprises a first side that is connected with all of the plurality of image bus X electrodes, the integrated bus X electrode having a thickness that is different from a thickness of the image bus X electrodes, the integrated bus X electrode being arranged in the non-image area.

9. The plasma display panel of claim 8, wherein the thickness of the integrated bus X electrode is thicker than that of the image bus X electrodes.

10. The plasma display panel of claim 9, wherein the second side of the integrated bus X electrode is flush with a side edge of the front substrate, the second side of the integrated bus X electrode being connected to a flexible printed cable.

11. The plasma display panel of claim 10, the integrated bus X electrode further comprising an alignment mark arranged at a location on the integrated bus X electrode that connects to the flexible printed cable.

12. The plasma display panel according to claim 8, the integrated bus X electrode being black in color.

13. A plasma display panel, comprising:

a lower plate comprising a rear substrate and a plurality of first electrodes arranged in a first direction on a top surface of the rear substrate; and an upper plate comprising a front substrate arranged to face the rear substrate, a plurality of bus Y electrodes and bus X electrodes formed in a second direction and formed essentially orthogonal to the first electrodes on a lower portion of the front substrate;

a plurality of barrier ribs formed between the front and rear substrates dividing a space between the front and the rear substrates into a plurality of discharge cells, wherein each discharge cell comprises a layer of colored phosphor, the plasma display panel further comprising an integrated bus X electrode formed on an edge of the plasma display panel on the front substrate, the integrated bus X electrode being in a portion of the plasma display that does not form visible images, the integrated bus X electrode being electrically connected to each of said bus X electrodes, the integrated bus X electrode extending to an edge of the plasma display panel so that the integrated bus X electrode is flush with an edge of the front substrate.

14. The plasma display panel of claim 13, the integrated bus X electrode being thicker than each of the bus X electrodes.

15. The plasma display panel of claim 13, the integrated bus X electrode being formed simultaneously with each of the bus X electrodes.

16. The plasma display panel of claim 13, the integrated bus X electrode being electrically connected to a flexible printed cable.

17. The plasma display panel of claim 16, the integrated bus X electrode comprising an alignment mark to mark where the flexible printed cable attaches to the integrated bus X electrode.

18. The plasma display panel of claim 13, a side of the integrated bus X electrode that is closest to an edge of the plasma display panel is flat and not jagged.

19. The plasma display panel of claim 13, the integrated bus X electrode being rectangular in shape and being absent any additional protrusions.

20. The plasma display panel of claim 13, the integrated bus X electrode having a high conductivity material.

* * * * *